United States Patent [19]

Vanni

[11] Patent Number: 5,018,896

[45] Date of Patent: May 28, 1991

[54] SNAP RING ASSEMBLY

[76] Inventor: Robert R. Vanni, 701 Tuxedo Ave., Brooklyn Heights, Ohio 44131

[21] Appl. No.: 368,420

[22] Filed: Jun. 19, 1989

[51] Int. Cl.[5] ..... B42F 3/00

[52] U.S. Cl. ..... 402/38; 402/80 P; 402/73; 402/39; 281/27.1

[58] Field of Search ..... 402/19, 20, 38, 75, 402/80 P, 500, 502, 73, 80 R, 39; 281/36, 29, 31, 36, 37, 39, 27.1, 27.2, 27.3

[56] References Cited

U.S. PATENT DOCUMENTS

| | | | |
|---|---|---|---|
| 837,106 | 12/1910 | Sturgis | 402/39 |
| 879,928 | 2/1908 | Trussell | 402/39 |
| 1,769,120 | 7/1930 | Dawson | 402/39 |
| 2,051,617 | 10/1936 | Newman | 402/39 |
| 3,105,494 | 10/1963 | Duncan | 402/39 |
| 3,995,961 | 12/1976 | Dorfmann et al. | 402/38 |
| 4,295,747 | 10/1981 | Errichiello | 402/80 P |
| 4,566,817 | 1/1986 | Barrett, Jr. | 402/38 |
| 4,607,970 | 10/1986 | Heusinkveld | 402/80 P |

*Primary Examiner*—Douglas D. Watts
*Assistant Examiner*—Thomas Hamill, Jr.
*Attorney, Agent, or Firm*—Albert E. Chrow

[57] ABSTRACT

Provided is a snap ring assembly (100) for use in holding papers together such as in a two or three-ring looseleaf notebook or binder. Assembly (100) is preferably a one-piece molded construction including an elongate base portion (30) extending between sidewalls including respective proximate sections (32, 32') extending transversly therefrom and distal sections (34, 34') that are separated by respective hinge sections (38, 38') and respective free-ends that are configured to matingly engage to cause ring sections (38, 38') to snap together to provide a closed connection when distal sections (34, 34') are pivoted for a predetermined distance toward each other.

12 Claims, 4 Drawing Sheets

6
58'
58
56
30

6
5
60

4
5
60

SNAP RING ASSEMBLY

This invention relates generally to a snap ring assembly such as for use with a two or three-ring looseleaf notebook or binder and more particularly to a snap ring assembly that features a pair of spaced apart pivotal distal sections carrying respective ring sections and having free-ends respectively configured to matingly engage each other when the distal sections are pivoted toward each other and create a force operating to snap the ring sections into a releasably closed condition and is further preferably made as a one-piece molded construction.

BACKGROUND OF THE INVENTION

Snap Ring assemblies have been used for many years for holding papers together. Most familiar are the two and three-ring looseleaf notebooks and binders utilizing such snap ring assemblies. Generally, the snap rings comprise two arcuate spaced apart ring halves that are in substantial registration with each other and that can be pivoted from an open condition toward each other and, at some predetermined position, are caused to snap together to provide closed condition. The papers characteristically include perforated holes adjacent one end that are positioned so that one of the ring halves can be received therethrough before the ring halves are piloted into the closed condition. Although snap rings of the type hereinbefore described have for many years been made from metal, more recently many have been made from molded plastic polymer such as the one-piece binder disclosed in U.S. Pat. No. 4,607,970 and the one-piece ring binder molded from polypropylene polymers disclosed in U.S. Pat. No. 4,295,747, the disclosures of both of which are incorporated herein by reference.

The snap ring assembly readily lends itself to preferably being made as a one-piece molded construction from suitable plastic polymers rendering it economical to manufacture, yet highly effective in operation.

SUMMARY OF THE INVENTION

Accordingly, it is an object of this invention to provide a snap ring assembly for use for example in two and three-ring looseleaf notebooks and binders.

It is another object of this invention to provide a snap ring assembly for holding papers together that is economical to manufacture by being capable of being produced as a one-piece molded plastic construction.

DESCRIPTION OF SOME PREFERRED EMBODIMENTS

Figures 1, 2, 3:
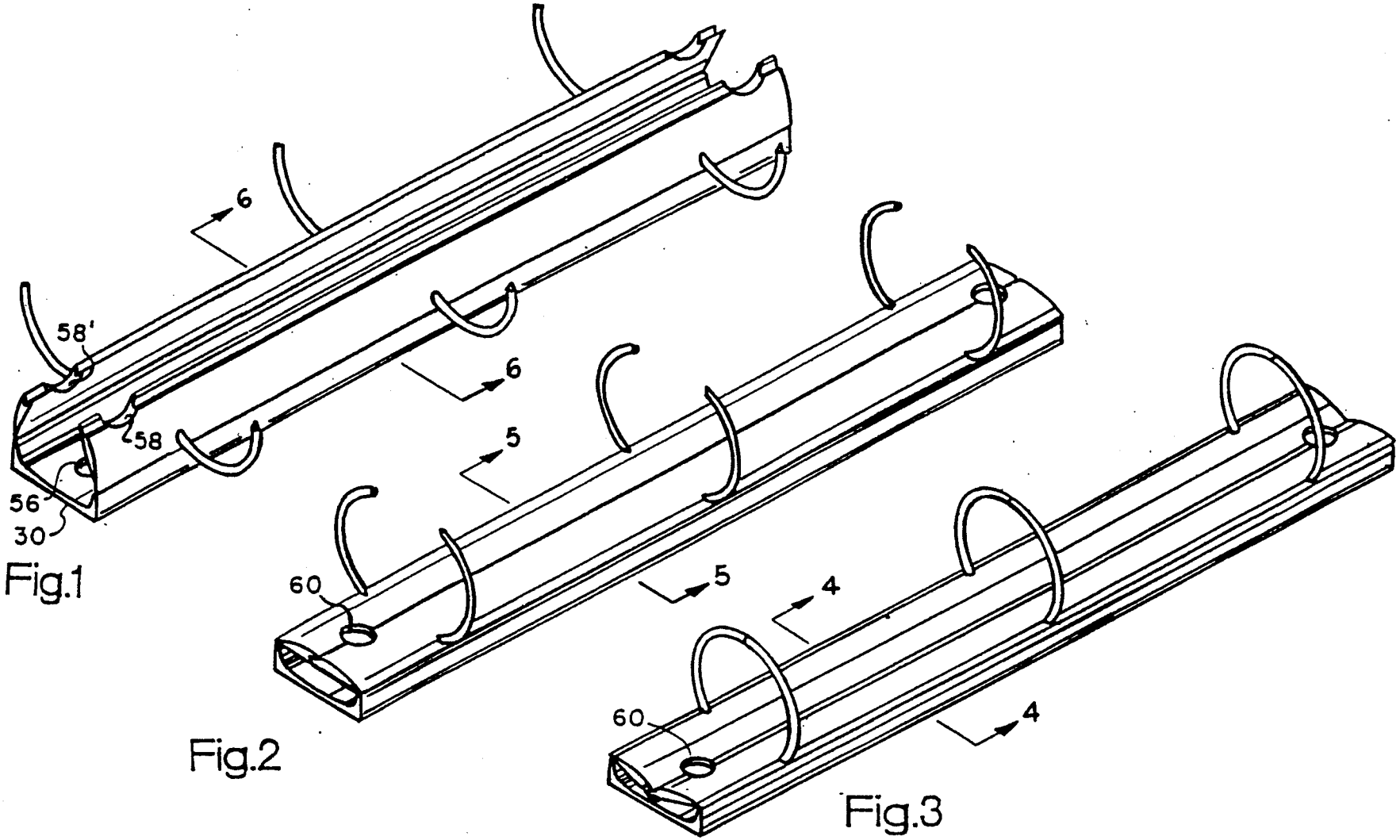
FIG. 1 is a perspective view of a snap ring Assembly 100 of the invention that is in an open condition.
FIG. 2 is a perspective view of Assembly 100 in a partially closed condition.
FIG. 3 is a perspective view of Assembly 100 in a closed condition.

By way of introduction, FIG. 1–3 show progressive closing of a snap ring Assembly 100 of the invention in which, in FIG. 1, Assembly 100 is in an open condition; in FIG. 2 in a partially closed condition; and in FIG. 3 in a closed condition.

Figure 6:
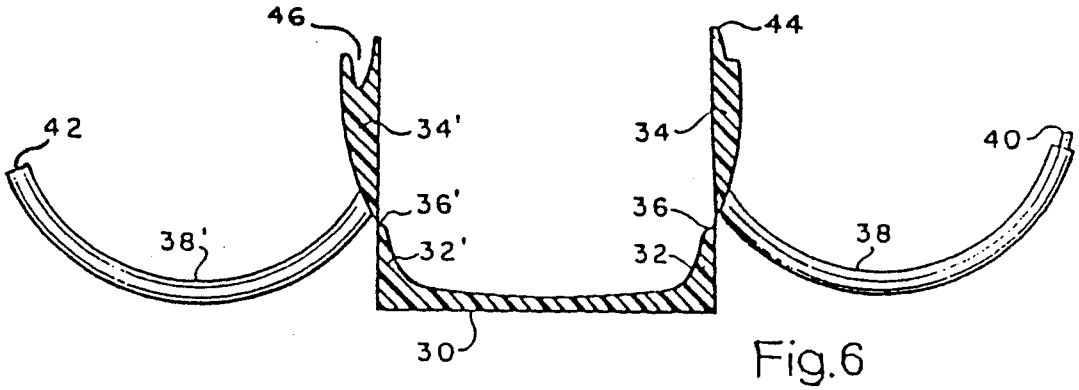
FIG. 6 is a cross-sectional view of Assembly 100 of FIG. 1 taken along view line 16—16.

In FIG. 6, Assembly 100 is in the open condition shown in FIG. 1. Assembly 100 has an elongate base portion 30 extending between side walls comprising corresponding proximate sections 32 and 32' and corresponding distal sections 34 and 34' that are separated from proximate sections 32 and 32' by reduced thickness hinge sections 36 and 36'.

Distal sections 34 and 34' are operable to pivot away from and toward each other about hinge sections 36 and 36' respectively and, as shown in the FIGURES, proximate sections 32 and 32' preferably have a tapered cross-section whose thickness decreases in a direction away from base portion 30.

Arcuate ring sections 38 and 38' extend away from respective sides of distal sections 34 and 34' facing away from base portion 30 at a predetermined distance from hinge sections 36 and 36' as shown in FIG. 6. Ring sections 38 and 38' are in substantial registration with each other and extend to respective free-ends that contactingly engage each other when Assembly 100 is in the closed condition. Preferably one of the free-ends includes a protuberance 40 extending therefrom and the other free-end includes an opening 42 adapted to receive protuberance 40 therein when Assembly 100 is in closed condition to maintain alignment between the free-ends of ring sections 38 and 38'.

Distal sections 34 and 34' extend respectively from hinge sections 36 and 36' to respective free-ends that are configured to matingly engage each other. The mated engagement is preferably provided by a male-female configuration such as where the free-end of distal section 34' is a lip or tongue 44 and the free-end of distal section 34' is a groove or channel 46 adapted to receive tongue 44 therein as Assembly 100 is change from an open to a closed condition.

The open condition of Assembly 100 shown in FIG. 6 lends itself well to split die plastic molding to provide a one-piece construction including ring sections 38 and 38' and also to provide only base portion 30 and proximate sections 32 and 32' and hinge sections 36 and 36'and distal sections 34 and 34'when ring sections 38 and 38' are separately secured and not an integral part.

Hinge sections 36 and 36' are of the type known in the trade as "live hinges" by exhibiting flexibility and high resistance to flex fatigue of which polypropylene has been found to be a highly effective material from which to make the assembly of the invention as a one-piece molded construction including a hinge section between the proximate and distal sections hereinbefore described.

Figure 4:
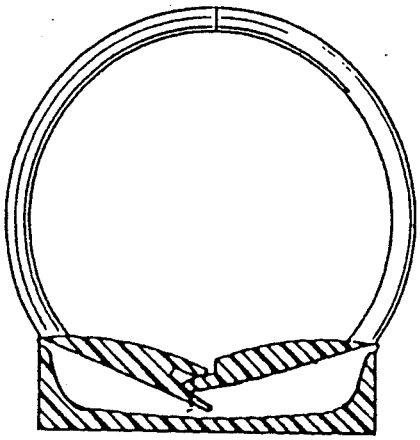
FIG. 4 is a cross-sectional view of Assembly 100 of FIG. 3 taken along view line 20—20.
Figure 5:
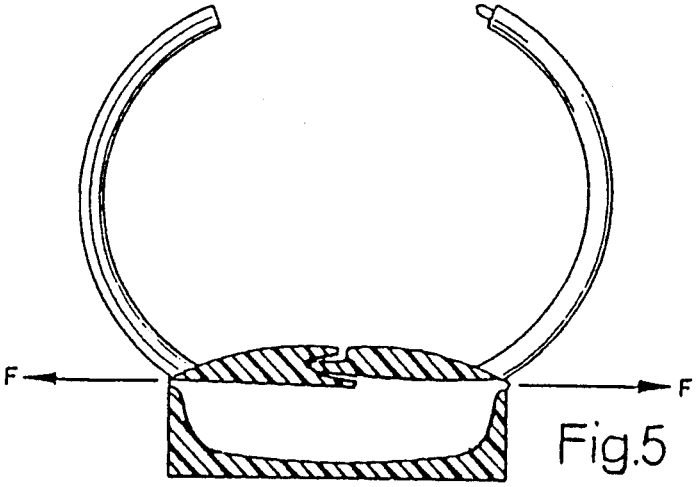
FIG. 5 is a cross-sectional view of Assembly 100 of FIG. 5 taken along view line 18—18.

In operation, distal section 34 and 34' are pivoted toward each other from the open position shown in FIG. 6 to a first predetermined position at which the free ends of distal sections 34 and 34' matingly engage and are adapted such that further pivoting in the same direction creates an opposed outwardly directed force "F" against hinge sections 36 and 36' that is operative to cause distal sections 34 and 34' to snap into the second predetermined position shown in FIG. 4 during which the free-ends of ring sections 38 and 38' are brought into contacting engagement to provide the closed position of Assembly 100 shown in FIG. 4 while maintaining mated engagement between the free-ends of distal section 34 and 34'.

Figure 7:
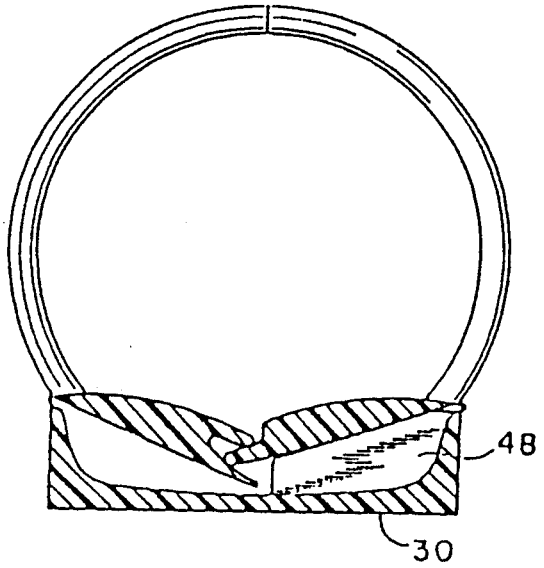
FIGS. 7 and 8 are respective cross-sectional and top plan views of a snap ring assembly of the invention in a closed condition and further including a stopping member 48 and an end wall 52.
Figure 8:
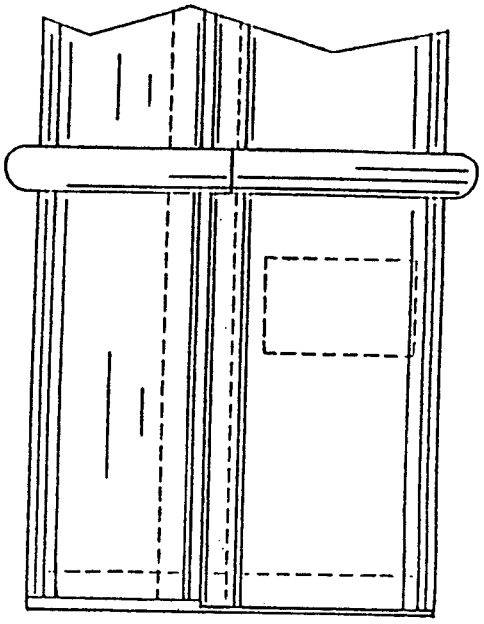

As shown in FIGS. 7 and 8, the snap ring assembly of the invention may further include a stopping member 48 disposed on base portion 30 which engages at least one of the distal sections when the assembly is in the closed condition and is adapted to maintain mated engagement between the free-ends of the distal sections. There may of course be more than one stop member disposed along the length of base portion 30 and they may be integrally molded therewith when the assembly is a one-piece molded construction.

Figure 9:
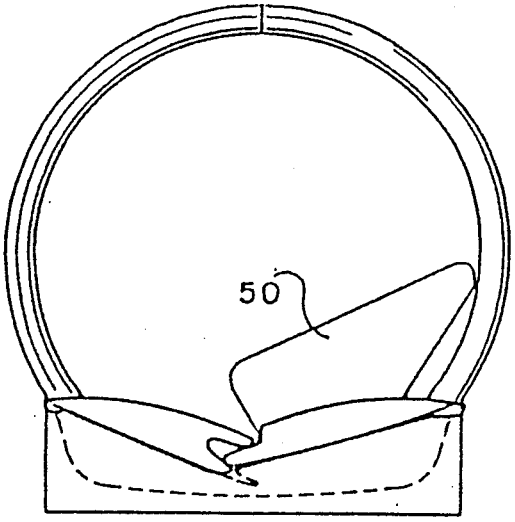
FIGS. 9 and 10 are respective cross-sectional and top plan views of a snap ring assembly of the invention further including a lever 50 to enhance operation.
Figure 10:
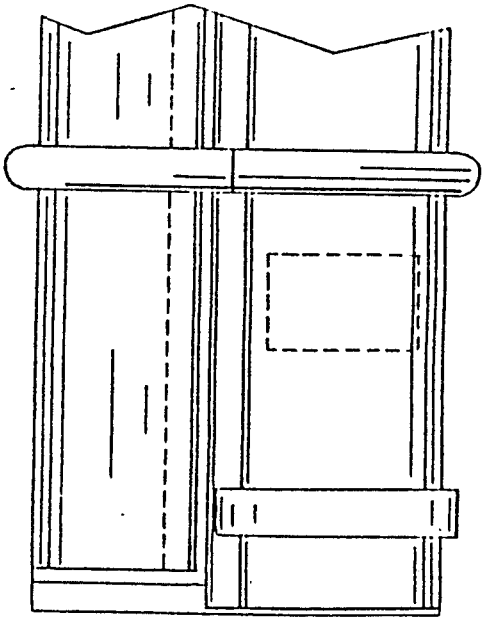

FIGS. 9 and 10 illustrate that the snap ring assembly of the invention may include a lever arm such as arm 50 secured to a side of at least one of the distal sections facing away from the base portion that is adapted to enhance pivoting the distal section to cause the ring section to move between the open end closed conditions. Like stop member 48, lever arm 50 may be an integrally molded part of the assembly.

Figure 11:
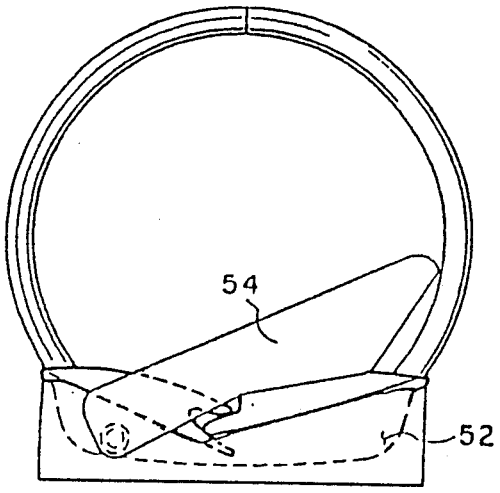
FIGS. 11 and 12 are respective cross-sectional and top plan views of a snap ring assembly of the invention further including a locking member 54.
Figure 12:
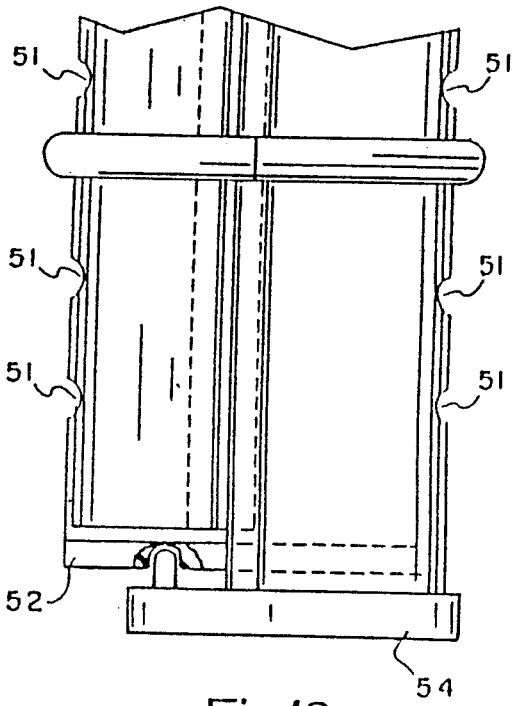

FIGS. 11 and 12 illustrate that the assembly of the invention may further include a locking member 54 that is pivotally mounted to the assembly at one end and is adapted to pivotally engage a side of at least one of the distal sections facing away from the base position after the assembly is in the closed condition and hold the distal section in a releasably locked condition to prevent the distal section from pivoting in an opposite direction.

The assembly of the invention may further include an end wall at one or both ends such as end wall 52 shown in FIGS. 11 and 12 to which locking member 54 can then be pivotally mounted.

FIG. 12 illustrates that the assembly of the invention may also include one or more openings 51 through at least one of hinge sections 36 and 36' to lessen resistance to pivotal movement of dictal sections 34 and 34' relative proximate sections 32 and 32 respectively.

Figure 13:
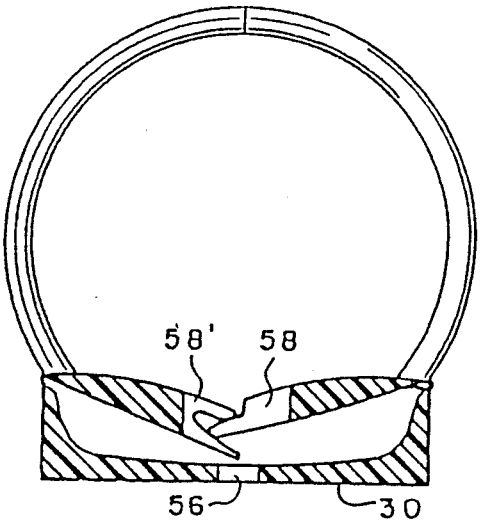
FIG. 13 is a cross-sectional view taken through opening 56 shown in FIG. 1.

As shown in FIGS. 1 and 13, base portion 30 may include one or more openings 56 spaced there along that are adapted to enable a preselected fastener to be received therethrough for securing the assembly to a selected substrate such as a looseleaf binder cover.

The assembly of the invention may further include opposed recesses 58 and 58' in the free-ends of distal sections 34 and 34' shown in FIGS. 1 and 13 that are in substantial registration with each other and define an aperture 60 that is in substantial axial alignment with opening 56 when the assembly is moved from the open toward the closed condition to provide access to opening 56 and any fastener such as a rivet extending therethrough.

Figure 14:
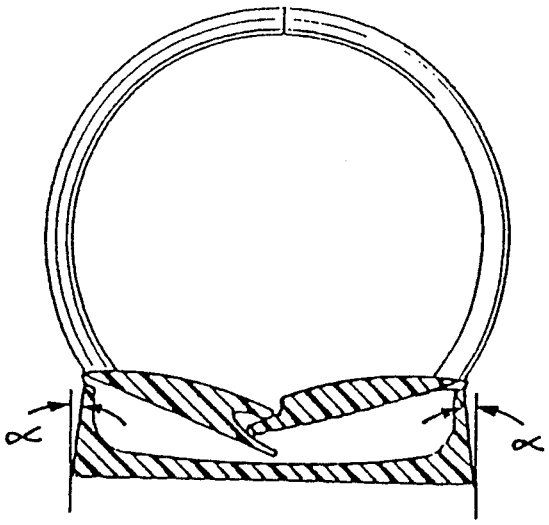
FIG. 14 is a cross-sectional view of a snap ring assembly of the invention having inwardly inclined proximate side wall sections 32 and 32'.

FIG. 14 illustrates that the assembly of the invention may further included proximate sections 32 and 32' that are inclined inwardly toward each other by a predetermined angle Alpha from vertical. Such is effective to enhance the snap action by which ring sections 38 and 38' move into the closed condition.

Although the present invention has been set forth with a certain degree of particularity, it is understood that various modifications are possible without departing from the spirit and scope of the invention as heretofore claimed.

I claim:

1. A one-piece molded snap ring assembly, said assembly comprising; an elongated base portion extending between a pair of spaced-apart sidewalls, each of said sidewalls having a proximate section extending transversely from the base portion, a distal section, and a hinge section extending integrally therebetween having a tapered cross-section that becomes progressively thinner in a direction from the base portion toward the hinge section, said hinge sections having a reduced thickness predetermined to enable the distal section to pivot thereat relative the proximate sections, said distal sections ending in respective free-ends respectively configured to matingly engage each other, said distal sections having respective arcuate ring sections that are in substantial registration with each other and that extend substantially transversely from respective sides thereof facing away from the base portion to respective free-ends thereof at a predetermined distance from the hinge sections, and said assembly adapted such that pivotal movement of the distal sections toward each other to a first predetermined position causes the distal sections free-ends to matingly engage while causing the ring sections to pivot toward each other simultaneously therewith and further pivotal movement of the distal sections in the same direction to a second predetermined position is operative to create a force against the hinge sections effective to cause the hinge sections to snap the ring section free-ends into contacting engagement with each other to provide a closed condition thereof while maintaining mated engagement between the distal section free-ends.

2. The assembly of claim 1 including at least one stop member disposed on the base portion and operative to engage at least one of the distal sections and prevent the distal section free-ends from disengaging each other when the ring sections are in the closed condition.

3. The assembly of claim 1 including a lever secured to at least one of the distal sections on a side thereof facing away from the base portion and operative to aid in pivoting the distal sections relative the proximate sections.

4. The assembly of claim 1 including a locking member adapted to pivotly engage a side of at least one of the distal sections facing away from the base portion when the ring sections are in the closed condition to prevent the distal sections from pivoting in an opposite direction.

5. The assembly of claim 1 wherein the base portion includes at least one opening therethrough between opposite ends thereof that is adapted to enable a preselected fastener to extend therethrough and secure the assembly to a substrate.

6. The assembly of claim 5 wherein the distal section free-ends include respective recesses therein that are in substantial registration with each other and define an apearture that is in substantial axial alignment with the opening through the base portion when the ring sections are in the closed condition.

7. The assembly of claim 1 wherein the base portion includes at least one end wall extending between the proximate sections.

8. The assembly of claim 7 including a locking member pivotally mounted to the end wall and adapted to pivotally engage at least one of the distal sections on a side thereof facing away from the base portion when the ring sections are in the closed condition and prevent the distal sections from pivoting in the opposite direction.

9. The assembly of claim 1 wherein at least one of the hinge sections includes at least one opening therethrough between opposite ends thereof that is operative to lessen resistance to pivotal movement of the distal sections relative to the proximate sections.

10. The assembly of claim 1 wherein one distal section free-end configuration is a tongue and the other distal section free-end configuration is a groove.

11. The assembly of claim 1 wherein one ring section free-end includes a protuberance extending therefrom and the other ring section free-end includes an opening adapted to receive the protuberance therein when the ring sections are in the closed condition.

12. The assembly of claim 1 wherein the respective proximate sections are inclined inwardly toward each other a predetermined angular amount from vertical as they extend away from the base portion.

* * * * *